United States Patent [19]

DiGiambattista

[11] Patent Number: 4,699,657

[45] **Date of Patent: * Oct. 13, 1987**

[54] MANUFACTURE OF FINE GRAIN METAL POWDER BILLETS AND COMPOSITES

[75] Inventor: Vincent N. DiGiambattista, Pittsburgh, Pa.

[73] Assignee: Worl-Tech Limited, Carnegie, Pa.

[ * ] Notice: The portion of the term of this patent subsequent to Dec. 30, 2003 has been disclaimed.

[21] Appl. No.: 926,418

[22] Filed: Nov. 3, 1986

[51] Int. Cl.[4] ..... B22F 1/00

[52] U.S. Cl. ..... 75/228; 72/272; 75/246; 419/23; 419/28; 419/31; 419/38; 419/48; 419/53; 419/66; 419/67

[58] Field of Search ..... 419/28, 31, 38, 48, 419/53, 66, 23, 67; 75/228, 246; 72/272

[56] References Cited

U.S. PATENT DOCUMENTS

| | | | |
|---|---|---|---|
| 2,955,709 | 10/1960 | Sejournet | 207/10 |
| 3,010,196 | 11/1961 | Smith et al. | 29/420.5 |
| 3,871,200 | 3/1975 | Onoda et al. | 419/48 |
| 3,899,821 | 8/1975 | Ito et al. | 419/48 |
| 4,040,162 | 8/1977 | Isogai et al. | 419/48 |
| 4,050,143 | 9/1977 | Aslund | 419/48 |
| 4,104,061 | 8/1978 | Roberts | 419/29 |
| 4,131,461 | 12/1978 | DePierre et al. | 75/208 |
| 4,155,776 | 5/1979 | Romer | 136/217 |
| 4,388,054 | 6/1983 | Larsson | 419/48 |
| 4,632,702 | 12/1986 | DiGiambattista | 419/48 |

*Primary Examiner*—Stephen J. Lechert, Jr.

*Attorney, Agent, or Firm*—Buell, Ziesenheim, Beck & Alstadt

[57] ABSTRACT

Very fine grain metal billets are produced by loading alloy metal powder of desired composition into a metal extrusion container in successive layers of two or four inches deep. Each layer after loading is compacted by a high energy rate forming ram so as to introduce energy on the order of $3\times10^6$ psi per layer and at least $18\times10^6$ psi total. An inner plate is then loosely placed on the compacted powder. On top of the inner plate is placed a cover plate which is welded to the container. The filled container is then heated in a furnace to an extrusion temperature below the melting point of the alloy and is extruded in an extrusion press having a ratio of about 3:1 with a force of about 3,000 tons. The inner plate does not move at the same rate as the container and in effect is partially extruded against the powder so as to raise the density of the extruded billet to substantially 100% of its theoretical density.

The energy stored in the compacted powder is released by the heating and the extrusion causing multiple dislocations of the grain within a given particle and resulting in a very fine grain size, as small as 25 on the Snyder-Graff intercept scale.

If desired the powder may be compacted around a solid metal core. The inner cover plate is then provided with a clearance hole; the outer plate also has clearance but is welded to the core. The resulting extruded billet then has a very fine grain circumferential region.

13 Claims, 8 Drawing Figures

MANUFACTURE OF FINE GRAIN METAL POWDER BILLETS AND COMPOSITES

This invention relates to the production of fine grain metal powder billets and composites. It is more particularly concerned with manufacture by extrusion of such billets and composites made from metal powder and having very fine grains as determined by the Snyder-Graff intercept method. It is also concerned with such billets having densities approximately 100% of theoretical desities but employing reduction ratios considerably less than those heretofore employed, thus permitting manufacture of extrusions of relatively large cross-section.

RELATED APPLICATION

This application is related to my application Ser. No. 849,794, filed Apr. 9, 1986 for Manufacture and Consolidation of Alloy Metal Powder Billets.

PRIOR ART

It is known to produce metal billets from finely divided metal powders by filling an extrusion container with metal powder, sealing the container and in some cases evacuating it, heating it to a suitable temperature below the melting point of the powder, and extruding the container and powder through a die. In order to obtain a density in the extruded product of approximately 100% of theoretical density very high pressures are required and those pressures are obtained from available extrusion presses by employing a reduction ratio as high as 12:1. The products so obtained are thus of limited cross-section.

Furthermore, although the metal powder available for the above-mentioned processes has very fine carbides, on the order of three microns or less, the grain size of the billets produced from such powder by previously employed processes is not as fine as it is desired for a number of purposes. Many of those purposes require material which is very fine grain over only a portion of its cross-section; for example hobs, some gears and the like require very fine grain metal only for their circumferential portions.

SUMMARY OF THE INVENTION

In my process to be described hereinafter I charge metal particles of the desired composition having a particle size of minus 80 mesh into an extrusion container, preferably a piece of carbon steel pipe. I prefer to use metal powder atomized by inert gas and cooled from its liquidus temperature to about 425 degrees C. in less than one-tenth of a second. The powder is loaded in successive level layers of about two to four inches thick and a high energy rate forming ram is applied to each layer after it is deposited. The energy introduced into each layer by the compacting is of the order $3\times10^6$ psi and I adjust the layers so that the powder in the container receives energy to a level of about $18\times10^6$ psi. The tap density of the powder so compacted is about 80% of theoretical. An inner plate is then loosely placed on the compacted powder in the extrusion container. This plate is also of carbon steel, perhaps three inches in thickness and is not attached to the container shell. On top of this inner plate is placed the cover plate of the same metal and thickness as the inner plate and the cover plate is welded to the container shell. The container so prepared is heated in a furnace to an extrusion temperature below the melting point of the alloy. For tool steel that temperature is from about 1400 degrees to about 1900 degrees F. For high temperature alloys such as are used in aircraft engines the range extends to about 2100 degrees F. This treatment raises the density of the powder in the container to about 90 to 93% of theoretical. The heated container is quickly placed in an extrusion press and the extrusion is made at a reduction ratio of about 3:1 and at a force of about 3000 tons. The inner plate not being affixed to the extrusion container does not move at the same rate as the container and in effect is partially extruded against the powder so as to raise the density of the extruded billet to substantially 100% of theoretical density.

The energy stored in the compacted powder is released by the heating and extrusion causing multiple dislocation of the grains within a given particle and resulting in a very fine grain size. In the Graff-Snyder intercept method of determining grain size the number of grains at a magnification of 1000 times crossed or touched by a line 0.005 inches long on the sample itself is counted. In general the intercept numbers above 15 designate a very fine grain size; from 12 to 15 fine grain size, and lower numbers medium or coarse grain size. The Snyder-Graff intercept method is described at pages 81 and 84 of "Tool Steels" Third Edition, published by the American Society for Metals. The grain size of extrusions produced by my process is very fine, as small as 25 or better.

If the very fine grain above-mentioned is required only in a limited area, for example around the circumference of a cylindrical billet, I prefer to insert a solid metal core in the container welded to the container bottom and carry out my process as hereinabove described but with a perforation in both inner and outer covers that fits snugly around the core. The outer cover is welded to the core.

BRIEF DESCRIPTION OF THE DRAWINGS

My invention will be described hereinafter in connection with the accompanying figures in which.

DESCRIPTION OF PREFERRED EMBODIMENTS

My process is well adapted to the production of billets and shapes of tool steel or other high alloy steel. My starting material is metal powder of the desired composition most easily obtained by mixing together metal powders of the desired elements or alloys in the desired proportion. I use metal powders of minus 80 mesh, that is, all the powder passes through an 80 mesh screen. I prefer to employ metal powders atomized by inert gas and cooled from the liquidus temperature to approximately 425 degrees C. very rapidly, in less than 1/10 of a second. A process which can be adapted to produce such powder is disclosed in Clark, et al. U.S. Pat. No. 4,272,463 of June 9, 1981.

Figure 1:
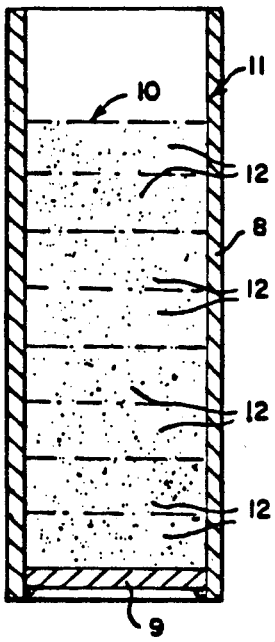
FIG. 1 is a longitudinal cross-section of an extrusion container loaded with metal powder in layers.
Figure 2:
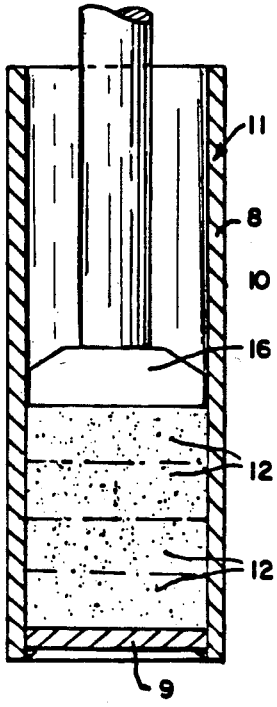
FIG. 2 is a longitudinal cross-section of an extrusion container with a high energy forming rate ram in position to compact the metal powder.
Figure 3:
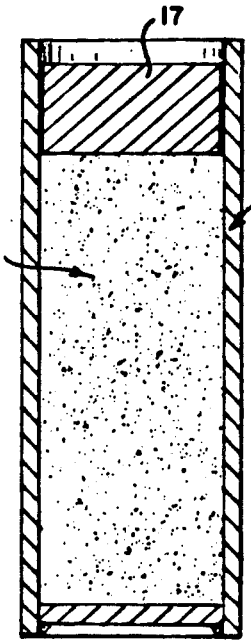
FIG. 3 is a longitudinal cross-section of an extrusion container loaded with compacted metal powder and having its inner cover plate in place.
Figure 4:
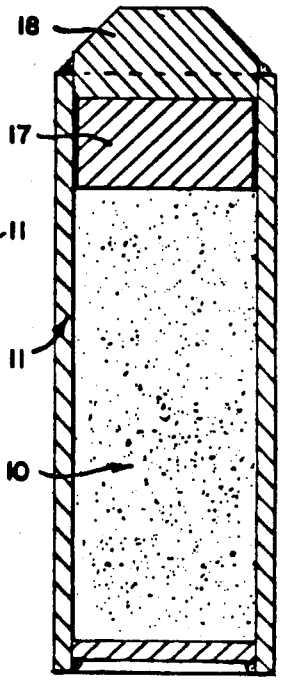
FIG. 4 is a longitudinal cross-section of the extrusion container of FIG. 3 with its outer cover plate in place and welded to the container shell.

The powder is charged or loaded into an extrusion container 11 which may be a piece of carbon steel pipe 8 having a bottom end 9 of carbon steel welded thereon. Into this container I load the metal powder 10 in level layers of about two inches thickness. Container 11 is thus charged with metal powder 10 in multiple superposed layers 12 as shown in FIG. 1. Each layer 12 after being charged is compacted by high energy rate forming ram 16 as shown in FIG. 2 so as to compact the powder in each layer to a tap density of about 80% of theoretical. I estimate that the energy level delivered to the metal powder layer by compacting is about $3\times10^6$ psi. This procedure is repeated until the container is filled to approximately four inches from the top. The total energy delivered to the metal powder in the container is about $18\times10^6$ psi. Then a carbon steel plate 17 fitting inside container 11 is placed loosely on the powder 10 in container 11 but is not welded or otherwise affixed to container 11. Plate 17 is about 3 inches thick and forms an inner cover for the powder. A similar disk or plate 18 is then placed on top of plate 17 and is welded to container 11 around the top edge of the latter as is shown in FIG. 4. Plate 18 is inset about one inch into container 11 and forms an outer cover therefor.

Container 11 so prepared is then placed in a heat treating furnace and is heated to an extrusion temperature substantially below the melting point of the alloy for four to six hours. For tool steels the heating temperature is from 1400 to about 1900 degrees F. For other alloys such as high temperature alloys used in aircraft engines the temperature range may extend to about 2100 degrees F. The heating increases the density of the metal powder 10 to approximately 90–93% of theoretical density.

Figure 5:
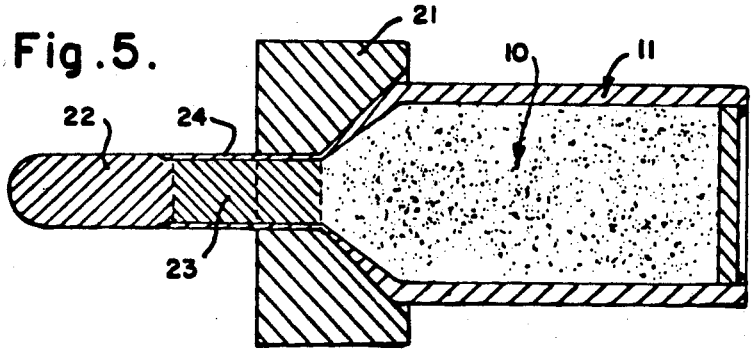
FIG. 5 is a longitudinal cross-section of the extrusion container of FIG. 4 partly extruded through an extrusion die.

The container 11 is then rapidly transferred from the heat treating furnace to the extrusion press in about a minute and extruded at a reduction ratio of about 3:1 at approximately 3000 tons pressure. In FIG. 5 extrusion container 11 is shown passing through extrusion die 21. Outer cover 18 is extruded into nose portion 22 of the extrusion and inner plate 17 is extruded into portion 23. As plate 17 is not attached to the wall of container 11 that wall is drawn over plate 17 as thinner wall 24. It is my belief that plate 17 is extruded into portion 23 of greater cross-sectional area than wall portion 24 which is therefore more highly strained than portion 23 and is elongated with respect thereto. Portion 23 in effect has been extruded backwards, further compacting the powder 10 in container 11 to a density of approximately 100% of theoretical. Snyder-Graff grain size of the extruded billet is no greater than about No. 25.

Figure 6:
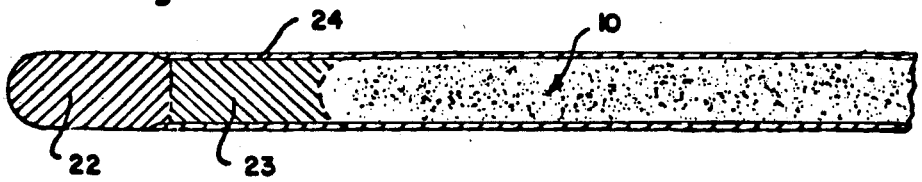
FIG. 6 is a longitudinal cross-section of the fully extruded container of FIG. 5.

FIG. 6 shows the billet produced when container 11 has been fully extruded.

Because of the added compaction of the powder 10 by the elongation of wall portion 24 occuring while plate 17 passes through the extrusion die it is possible to obtain a billet the full diameter of the extrusion container with density 100% of theoretical by stopping the extrusion process when plate 17 has passed through the die and removing the partially extruded container 11 without extruding the remaining portion.

EXAMPLE NO. 1

An M2 tool steel alloy containing the following nominal constituents: carbon, 0.85%, manganese, 0.30%, silicon 0.30%, chromium, 4.00%, vanadium, 2.00%, tungsten, 6.00%, molybdenum, 5.00% and the balance iron was first converted to powder by inert gas atomization using the rapid solidification method.

The resultant metal powder alloy was sieved through a No. 80 mesh U.S. standard sieve. This graded alloy metal powder was then placed into a stainless steel "V"-cone blender and blended for thirty minutes.

The metal alloy powder was then loaded into a 1010 carbon steel pipe with a bottom plate welded to the bottom and a cylindrical tool steel core of AISI 4130 steel welded upright to the bottom plate. The container measured 12 inches in diameter by 29 inches long. The core was three inches in diameter by 30 inches long. The powder was loaded into the container in two inch deep layers after which the high energy rate forming ram was brought into position and caused to impact a number of times. This procedure was continued until a full height of about 25 inches was achieved.

The floating or free moving disk was placed into the carbon steel container with the upper end of the core projecting through it. The second steel disk was then placed on top of the free moving disk with the upper end of the core projecting through it and was welded circumferentially to the carbon steel pipe and to the core.

The prepared extrusion shell was placed in a heat treating furnace heated to a temperature of 1700 degrees F. and allowed to soak for a period of 6 hours at 1700 degrees F.

The heated extrusion shell was automatically transferred from the heat treating furnace to the extrusion press in 40 seconds. The extrusion container was extruded through a 7.170 inch diameter die. The resultant extrusion was a 7.170 inch diameter billet a little less than about 7 feet long. The extruded product was then placed in a vermiculite bed and allowed to cool slowly to room temperature.

After cooling the extrusion head and tail were cut off and the container stripped therefrom. The resultant billet was then cogged at 1800 degrees F. to approximately 6 inches in diameter. The cogged billet exhibited excellent plastic deformation and elongation.

Following the cogging operation the powder metal billet was then hot rolled to a finished diameter of about 4 inches diameter.

Figure 8:
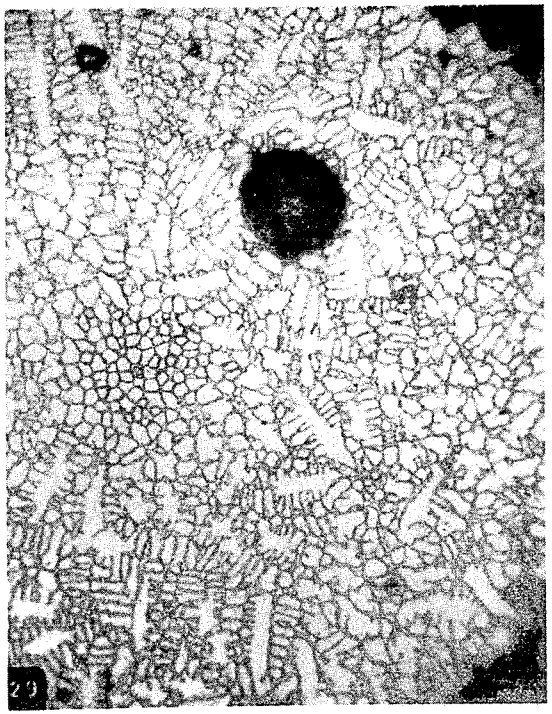
FIG. 8 is a photomicrograph at a magnification of 1000 times showing the very fine carbide particle size of about 2.5 microns of the billet resulting from the process as set out in Example 1 hereof.

The resultant product had a density of 100% of theoretical and consistently exhibited a grain size finer than No. 30 as determined by the Snyder-Graff intercept method. The carbide distribution was extremely fine; approximately 3 microns or finer, as is shown in FIG. 8. The resultant product was subjected to reflectascope analysis and found to be sound and free of defects.

Five Rockwell C hardness determinations were made at approximately equally spaced intervals on a radius of the billet core and showed values between 36.2 and 38.8. Seven equally spaced Rockwell C hardness determinations were made on the external portion of the radius from the core to the outer circumference of the billet and displayed values between 63.8 and 65.

A slice of the four-inch diameter hot rolled bar was subjected to standard heat treating procedures for M2 tool steel alloys and found to be very responsive to heat treatment as above indicated, and displayed a satisfactory metallurgical bond between the consolidated M2 alloy steel powder and the AISI 4130 tool steel core.

EXAMPLE NO. 2

Using the procedures described in Example No. 1 a T-15 alloy metal powder with the following nominal chemical analysis carbon, 1.55%, manganese, 0.30%, silicon 0.30%, chromium 4.50% vanadium, 5.00%, tungsten 13.00%, molybdenum, 0.50% and cobalt 5.00% the balance iron was extruded to a 7.170 inch diameter round and subsequently rolled to approximately three inches in diameter with results similar in respect to those above-mentioned in regard to density, grain size and soundness.

EXAMPLE NO. 3

Using the procedures described in Examples Nos. 1 and 2, a typical M2 tool steel alloy metal powder was subjected to a partial extrusion whereby just the mechanical device located in front of the extrusion shell was extruded to a predetermined length sufficient to allow the free moving disk to move to a point sufficient to exert a pressure against the powder to result in approximate 100% density, as shown in FIG. 5.

The resultant product from the partial extrusions was subsequently cogged down to an approximately six-inch diameter billet by approximately 7 feet long, then hot rolled to a four-inch round-cornered square billet, with results similar in all respects to those obtained from the fully extruded and rolled products above discussed.

EXAMPLE NO. 4

Figure 7:
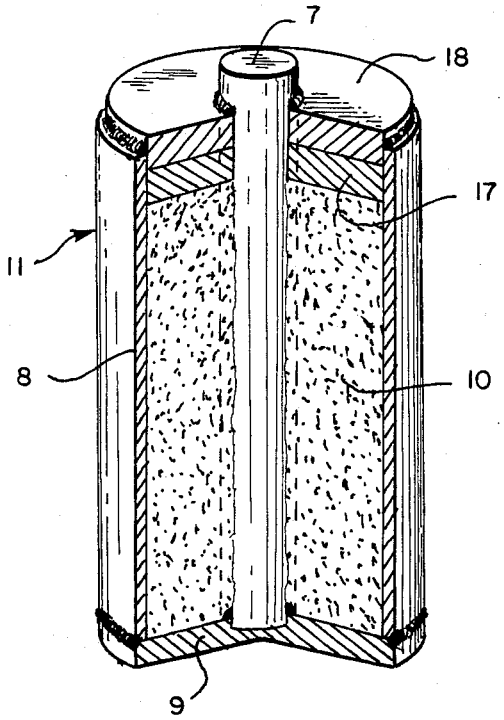
FIG. 7 is a cut away isometric view of an extrusion container with solid alloy steel core loaded as described in Example 4 hereof.

Using the procedures described in Example No. 1 with the exception of the cogging operation an M-3 type II alloy metal powder with the following nominal chemical analysis carbon, 1.22%, manganese, 0.80%, sulfur, 0.30%, silicon 1.25%, chromium, 4.10%, vanadium 3.2%, tungsten 6.0%, molybdenum, 6.0% with the balance iron was loaded into a sixteen inch diameter seamless pipe by sixty nine inches in length and containing a tool steel alloy core of AISI 4140 measuring 8 inches in diameter by sixty nine inches long. The loaded container with core 7 is shown in FIG. 7. Forming ram 16 was structured with a central opening through which core 7 passed, as were cover plates 17 and 18. The extrusion container, which weighed 3,800 pounds, was extruded to a 7 inch diameter by approximately 30 foot long billet. The results in regard to density, grain size and soundness were similar to the results in Examples 1, 2 and 3.

As I have mentioned I prefer to use carbon steel pipe for my extrusion container. The wall thickness of 12 inch carbon steel pipe is somewhat greater than a quarter inch but less than a half inch. As long as the extrusion container is made from metal having a lower resistance to deformation than the metal of the billet the wall thickness of the container is not critical.

In the foregoing examples the inner cover 17 is formed with parallel faces. In my related application Ser. No. 849,794 I describe an inner cover having a convex lower face and its method of use which results in significant increase in yield of the extruded billet. Such an inner cover plate produces the same improved yield in my process here described.

My process here described is not limited to steel and steel alloys but is suitable for other metals, and composites, such as beryllium, titanium, magnesium and aluminum.

While I have shown and described present preferred embodiments of my invention and have illustrated present preferred methods of practicing the same it is to be distinctly understood my invention is not limited thereto but may be otherwise variously embodied within the scope of the following claims.

I claim:

1. The method of producing dense billets of metal powder having very fine averge Snyder-Graff grain size comprising loading the powder in layers into a container formed from metal having a lower resistance to deformation than the metal of the billet, compacting each layer of metal by a high energy rate forming ram to a level of about $3\times10^6$ psi, adjusting the thickness and number of layers so that the powder in the container receives total energy at a level of at least $18\times10^6$ psi, covering the powder so compacted with an inner plate not attached to the container, covering the inner plate with a cover plate and attaching it to the container, both plates being made of metal having a lower resistance to deformation than the metal of the billet and having thicknesses several times that of the container wall, heating the filled container to an extrusion temperature below the melting point of the container and the metal powder and hot extruding the filled container cover plate first, whereby the energy stored in the powder particles by compacting them is released causing multiple dislocations of the grains within a single particle.

2. The method of claim 1 in which the depth of each said layer is between about 2 inches and about 4 inches.

3. The method of claim 1 including the step of inserting a solid metal bar core into the container, loading and compacting the powder around the core, covering the powder in the containaer with an inner plate not attached to the container and having a hole therein snugly fitting around the core, covering the inner plate with a cover plate and attaching it to the container and to the core, thereby producing a billet with a fine grain powder annular portion.

4. The method of claim 1 or 3 in which the very fine average Snyder-Graff grain size is no greater than about 25.

5. The method of claim 1 in which the container and cover plates are formed of carbon steel and the powder is of an alloy harder than carbon steel.

6. The method of claim 1 in which the container wall is not more than one-half inch thick and the inner and outer covers are about three inches thick.

7. The method of claim 1 in which the metal powder was atomized by an inert gas and cooled from its liquidus temperature to about 425 degrees C. in no more than one-tenth of a second.

8. The method of claim 1 including the step of heating the filled container to a temperature below the melting temperature of the container and the metal powder for about four to six hours, thereby increasing the density of the powder before extrusion to about 93% of theoretical.

9. The method of claim 1 in which the filled container is hot extruded at a reduction rate of about three to one and a pressure of about 50,000 psi.

10. The method of claim 1 in which the extrusion of the filled container is stopped after the cover plate and inner plate have been extruded, whereby the density of the unextruded portion is raised to substantially 100% of theoretical.

11. A very fine grain metal powder billet produced by the method of claim 1.

12. A composite billet having a very fine grain metal powder annular portion only produced by the method of claim 3.

13. A billet of claim 11 or 12 having a Snyder-Graff grain size no greater than about 25 and a carbide particle size within the grain not greater than about 3 microns.

* * * * *

UNITED STATES PATENT AND TRADEMARK OFFICE

CERTIFICATE OF CORRECTION

PATENT NO. : 4,699,657

DATED : October 13, 1987

INVENTOR(S) : VINCENT N. DIGIAMBATTISTA

It is certified that error appears in the above-identified patent and that said Letters Patent is hereby corrected as shown below:

Column 1, line 12, change "desities" to --densities--.

Column 6, line 20, Claim 1, change "averg to --average--.

Signed and Sealed this

First Day of March, 1988

*Attest:*

*Attesting Officer*

DONALD J. QUIGG

*Commissioner of Patents and Trademarks*